US009041638B2

(12) United States Patent
Katagiri et al.

(10) Patent No.: US 9,041,638 B2
(45) Date of Patent: May 26, 2015

(54) LIQUID CRYSTAL DRIVING CIRCUIT HAVING A COMMON-SIGNAL OUTPUT CIRCUIT AND A SEGMENT-SIGNAL OUTPUT CIRCUIT AND METHOD

(75) Inventors: Norikazu Katagiri, Oizumi-machi (JP); Tetsuya Tokunaga, Oizumi-machi (JP); Mamoru Yamaguchi, Oizumi-machi (JP); Hiroyuki Nakamura, Ora-machi (JP)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 414 days.

(21) Appl. No.: 13/191,075

(22) Filed: Jul. 26, 2011

(65) Prior Publication Data

US 2012/0026153 A1 Feb. 2, 2012

(30) Foreign Application Priority Data

Jul. 29, 2010 (JP) ..... 2010-170777

(51) Int. Cl.
*G09G 3/36* (2006.01)
*G09G 3/18* (2006.01)

(52) U.S. Cl.
CPC ..... *G09G 3/18* (2013.01); *G09G 2310/0267* (2013.01); *G09G 2310/0275* (2013.01)

(58) Field of Classification Search
CPC . G09G 3/3696; G09G 3/3216; G09G 3/3622; G09G 3/3681; G09G 3/3692
USPC ..... 345/87, 90, 94, 95, 98, 211–213; 315/169.1–169.4
See application file for complete search history.

(56) References Cited

U.S. PATENT DOCUMENTS

| | | | | |
|---|---|---|---|---|
| 5,684,501 | A * | 11/1997 | Knapp et al. | 345/94 |
| 6,100,867 | A * | 8/2000 | Gyouten | 345/95 |
| 2002/0171641 | A1 * | 11/2002 | Miyazaki | 345/211 |
| 2010/0103157 | A1 * | 4/2010 | Goto et al. | 345/211 |

FOREIGN PATENT DOCUMENTS

| | | |
|---|---|---|
| JP | 10-010491 | 1/1998 |
| JP | 11-352459 | 12/1999 |

OTHER PUBLICATIONS

Korean Intellectual Property Office, Notification of Submission of Opinions for Application No. 10-2011-0074959, Mail Date Sep. 3, 2012.

* cited by examiner

*Primary Examiner* — Ram Mistry
(74) *Attorney, Agent, or Firm* — Rennie William Dover

(57) ABSTRACT

A liquid-crystal-driving circuit includes: a plurality of resistors connected in series between a first and second potentials; one or more voltage follower circuits to impedance-convert one or more intermediate potentials between the first and second potentials, to be outputted, respectively, the intermediate potentials generated at one or more connection points between the resistors, respectively; a common-signal-output circuit to supply common signals to common electrodes of a liquid-crystal panel, respectively, the common signals each being at the first and second potentials, and the intermediate potentials; and a segment-signal-output circuit to supply segment signals to segment electrodes of the panel, respectively, the segment signals each being at the first and second potentials, and the intermediate potentials according to the common signals, the segment-signal output circuit to change the potentials of the segment signals in a ramp form, at least if the potentials of the segment signals are changed with a maximum-possible-potential difference.

20 Claims, 10 Drawing Sheets

LIQUID CRYSTAL DRIVING CIRCUIT HAVING A COMMON-SIGNAL OUTPUT CIRCUIT AND A SEGMENT-SIGNAL OUTPUT CIRCUIT AND METHOD

CROSS-REFERENCE TO RELATED APPLICATION

This application claims the benefit of priority to Japanese Patent Application No. 2010-170777, filed Jul. 29, 2010, of which full contents are incorporated herein by reference.

BACKGROUND OF THE INVENTION

1. Field of the Invention

The present invention relates to a liquid crystal driving circuit.

2. Description of the Related Art

In a segment-display type or a simple matrix driving type liquid crystal panel, a common signal and a segment signal are supplied to a common electrode and a segment electrode, respectively, and turning on/off is controlled in accordance with a voltage (potential difference) between both the electrodes, in general.

In these liquid crystal panels, performing time-division driving enables display of more segments (pixels) than the number of output terminals of an IC for driving a liquid crystal. For example, in a liquid crystal panel with the number m of common electrodes and the number n of segment electrodes, performing 1/m duty driving enables display of m×n segments at the maximum. Further, in the time-division driving, 1/S bias driving is performed so that each signal can obtain (S+1) potentials. For example, in FIG. 4 of Japanese Patent Laid-Open Publication No. H10-10491, disclosed is an LCD driving power circuit used for 1/3 bias driving.

Here, a configuration of a common liquid crystal driving circuit that performs time-division driving and an example of an operation thereof are illustrated in FIGS. 7 and 8.

As illustrated in FIG. 7, intermediate potentials V1 and V2 obtained by dividing a power supply voltage V0 (=VDD−VSS) by a resistor R1 to R3 are supplied, in addition to power supply potentials VDD and VSS on a high-potential side and a low-potential side, to a common-signal output circuit 5 and a segment-signal output circuit 7. Therefore, in this liquid crystal driving circuit, 1/3 bias driving (S=3) is performed.

Further, FIG. 8 illustrates an operation of the liquid crystal driving circuit that performs 1/4 duty driving (m=4). As illustrated in FIG. 8, a common signal COMi ($1 \le i \le m$) is at a power supply potential for a 1/4 period and of an intermediate potential for a 3/4 period, in one period T0, and the waveform is shifted by 1/4 period each. On the other hand, a segment signal SEGj ($1 \le j \le n$) is at a potential according to turning on or off of four segments corresponding to segment electrodes to which the signal is supplied.

As such, use of the 1/m duty and 1/S bias driving method enable display of more segments than the number of output terminals of the IC for driving a liquid crystal.

The common electrode to which the common signal COMi is supplied and the segment electrode to which the segment signal SEGj is supplied are capacitively-coupled through liquid crystal, and thus, beard-like spike noise might be generated in one of the signals, which is caused by a change in potential of the other of the signals. Thus, in the liquid crystal driving circuit illustrated in FIG. 7, similarly to FIG. 4 in Japanese Patent Laid-Open Publication No. H10-10491, capacitors C1 and C2 are used as stabilizing capacities so as to absorb the spike noise and to stabilize the intermediate potentials V1 and V2. As illustrated in FIG. 9, such a liquid crystal driving circuit is known that stabilizes the intermediate potentials V1 and V2 using voltage follower circuits configured by operational amplifiers OP1 and OP2, respectively.

However, since the capacitance of the capacitor used as the stabilizing capacity is required to be sufficiently large in accordance with the liquid crystal panel, the capacitor usually results in an external component, which increases a mounting area of a circuit board. On the other hand, since output impedance of the operational amplifier which makes up the voltage follower circuit is required to be sufficiently small, current consumption is increased. Further, if the output impedance is not sufficiently small, as illustrated in FIG. 10, the spike noise Sp is not sufficiently absorbed, which might cause such defective display that an image remains in the liquid crystal panel.

Thus, in order to ensure favorable display quality, the current consumption of the liquid crystal driving circuit and the mounting area of the circuit board are in a trade-off relationship.

SUMMARY OF THE INVENTION

A liquid crystal driving circuit according to an aspect of the present invention, includes: a plurality of resistors connected in series between a first potential and a second potential lower than the first potential; one or more voltage follower circuits configured to impedance-convert one or more intermediate potentials between the first potential and the second potential, to be outputted, respectively, the one or more intermediate potentials generated at one or more connection points between the plurality of resistors, respectively; a common-signal output circuit configured to supply common signals to common electrodes of a liquid crystal panel, respectively, the common signals being at the first potential, the second potential, and the one or more intermediate potentials in a predetermined order; and a segment-signal output circuit configured to supply segment signals to segment electrodes of the liquid crystal panel, respectively, each of the segment signals being at the first potential, the second potential, and the one or more intermediate potentials in accordance with the common signals, the segment-signal output circuit configured to change the potentials of the segment signals in a ramp form, at least in a case where the potentials of the segment signals are changed with a maximum possible potential difference.

Other features of the present invention will become apparent from descriptions of this specification and of the accompanying drawings.

BRIEF DESCRIPTION OF THE DRAWINGS

For more thorough understanding of the present invention and advantages thereof, the following description should be read in conjunction with the accompanying drawings, in which.

DETAILED DESCRIPTION OF THE INVENTION

At least the following details will become apparent from descriptions of this specification and of the accompanying drawings.

—Outline of Configuration of Entire Liquid Crystal Driving Circuit—

An outline of a configuration of an entire liquid crystal driving circuit according to an embodiment of the present invention will hereinafter be described referring to FIG. 2.

Figure 2:
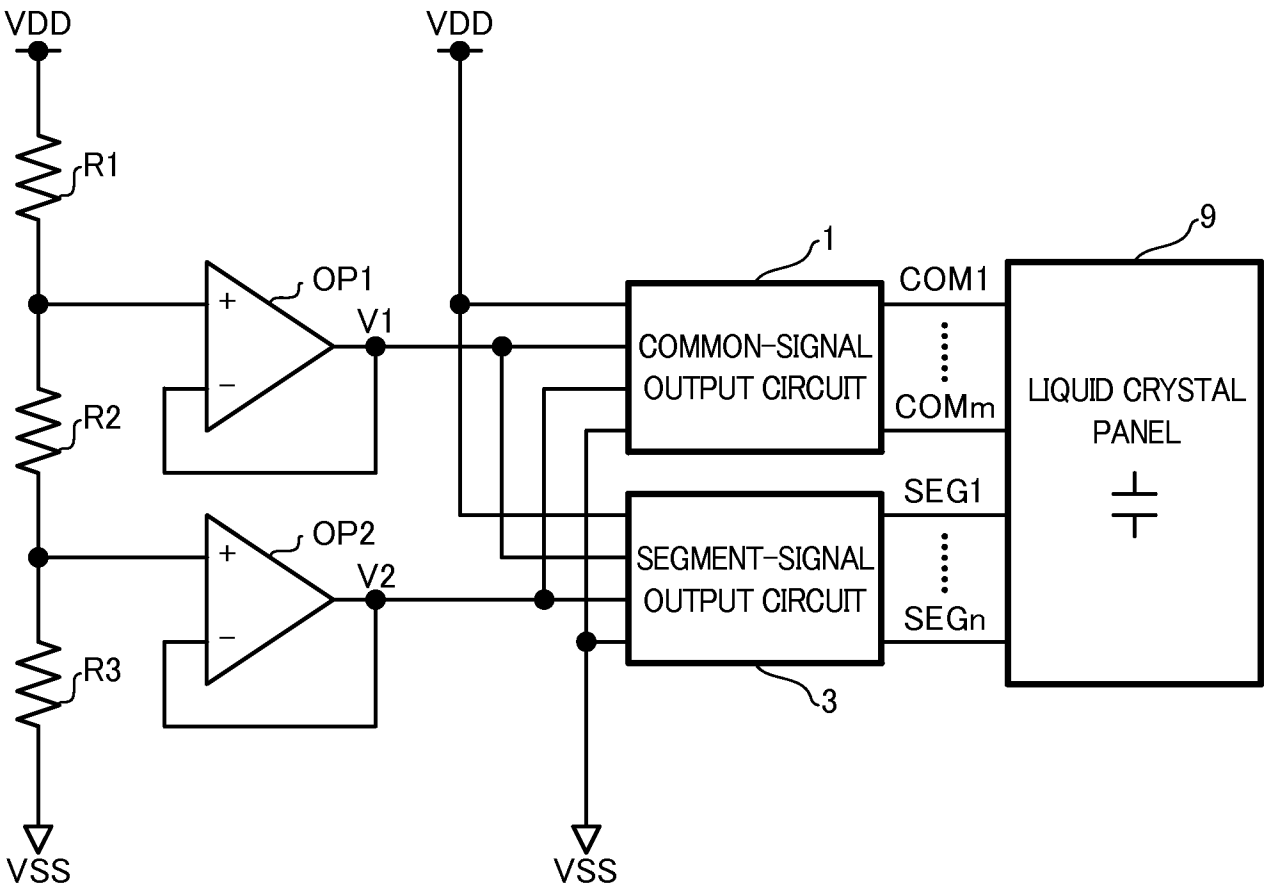
FIG. 2 is a circuit block diagram illustrating an outline of a configuration of an entire liquid crystal driving circuit according to an embodiment of the present invention.

The liquid crystal driving circuit illustrated in FIG. 2 is a circuit configured to drive a liquid crystal panel 9 and includes resistors R1 to R3, operational amplifiers OP1 and OP2, a common-signal output circuit 1, and a segment-signal output circuit 3.

The resistors R1 to R3 are connected in series in this order. One end of the resistor R1 is connected to a power supply potential VDD (first potential) on a high potential side, while one end of the resistor R3 is connected to a power supply potential VSS (second potential) on a low potential side.

The operational amplifier OP1 has a non-inverting input connected to a connection point between the resistors R1 and R2, and an inverting input and an output, which are connected to each other, thereby making up a voltage follower circuit. The operational amplifier OP2 has a non-inverting input connected to a connection point between the resistors R2 and R3, and an inverting input and an output, which are connected to each other, thereby making up a voltage follower circuit.

The power supply potentials VDD and VSS and the intermediate potentials V1 and V2 respectively outputted from the operational amplifiers OP1 and OP2 are supplied to both of the common-signal output circuit 1 and the segment-signal output circuit 3. Common signals COM1 to COMm outputted from the common-signal output circuit 1 are supplied to m pieces of common electrodes (not shown) of the liquid crystal panel 9, respectively. On the other hand, segment signals SEG1 to SEGn outputted from the segment-signal output circuit 3 are supplied to n pieces of segment electrodes (not shown) of the liquid crystal panel 9, respectively.

—Configurations of Common-Signal Output Circuit and Segment-Signal Output Circuit—

Figure 1:
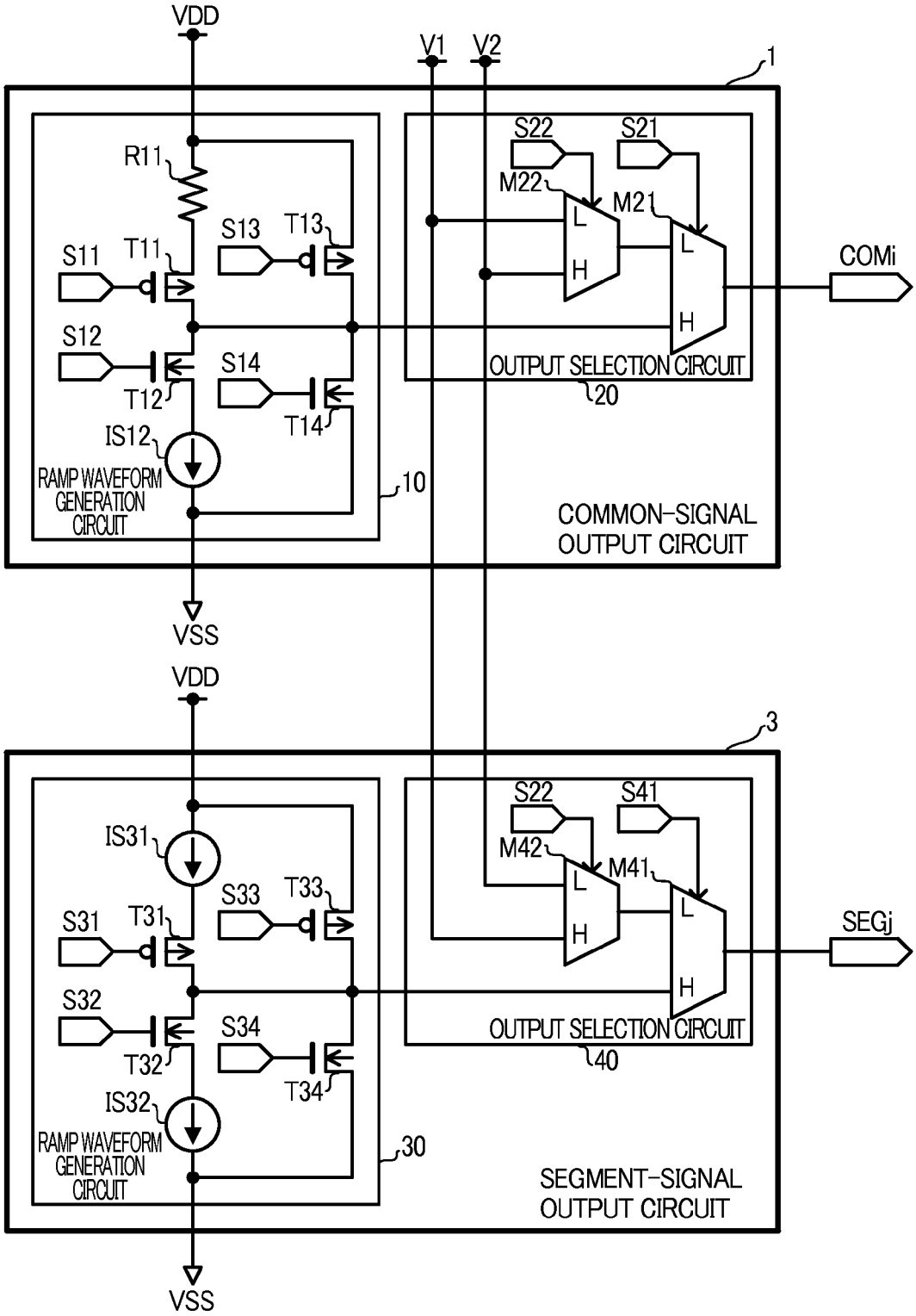
FIG. 1 is a circuit block diagram illustrating an example of specific configurations of a common-signal output circuit 1 and a segment-signal output circuit 3.

More specific configurations of the common-signal output circuit 1 and the segment-signal output circuit 3 will hereinafter be described referring to FIG. 1. FIG. 1 illustrates only one circuit configured to output an arbitrary common signal COMi ($1 \leq i \leq m$) among the common-signal output circuits 1, and only one circuit configured to output an arbitrary segment signal SEGj ($1 \leq j \leq n$) among the segment-signal output circuits 3.

The common-signal output circuit 1 includes a ramp waveform generation circuit 10 and an output selection circuit 20.

The ramp waveform generation circuit 10 includes a resistor R11, a current source 1512, a PMOS (P-channel Metal-Oxide Semiconductor) transistors T11 and T13, and an NMOS (N-channel MOS) transistors T12 and T14. The current source IS12 is configured with an NMOS transistor whose gate is applied with a predetermined bias voltage, for example.

The resistor R11 connected to the power supply potential VDD, the transistors T11 and T12, and the current source IS12 connected to the power supply potential VSS are connected in series in this order, and correspond to a first current supply circuit. Clock signals S11 and S12 are inputted to the gates of the transistors T11 and T12, respectively.

A source of the transistor T13 is connected to the power supply potential VDD, a drain thereof is connected to a connection point between the transistors T11 and T12, and a clock signal S13 is inputted to a gate thereof. A source of the transistor T14 is connected to the power supply potential VSS, a drain thereof is connected to the connection point between the transistors T11 and T12, and a clock signal S14 is inputted to a gate thereof.

The output selection circuit 20 includes multiplexers (selection circuits) M21 and M22. The 2-input to 1-output multiplexers M21 and M22 are each configured with two analog switches, for example.

A clock signal S22 is inputted to a selection control input of the multiplexer M22. Data inputs thereof corresponding to a low level and a high level of the clock signal S22 are connected to the intermediate potentials V1 and V2, respectively.

A clock signal S21 is inputted to a selection control input of the multiplexer M21. A data input thereof corresponding to a low level of the clock signal S21 is connected to an output of the multiplexer M22, and a data input thereof corresponding to a high level is connected to a connection point between the transistors T11 and T12. Then, the common signal COMi is outputted from the multiplexer M21.

The segment-signal output circuit 3 includes a ramp waveform generation circuit 30 and an output selection circuit 40.

The ramp waveform generation circuit 30 includes current sources IS31 and IS32, PMOS transistors T31 and T33, and NMOS transistors T32 and T34. The current sources IS31 and IS32 are configured with a PMOS transistor and an NMOS transistor whose gates are applied with predetermined bias voltages, respectively, for example.

The current source IS31 connected to the power supply potential VDD, the transistors T31 and T32, and the current source IS32 connected to the power supply potential VSS are connected in series in this order, and correspond to a second current supply circuit. Clock signals S31 and S32 are inputted to gates of the transistors T31 and T32, respectively.

A source of the transistor T33 is connected to the power supply potential VDD, a drain thereof is connected to a connection point between the transistors T31 and T32, and a clock signal S33 is inputted to a gate. A source of the transistor T34 is connected to the power supply potential VSS, a drain thereof is connected to the connection point between the transistors T31 and T32, and a clock signal S34 is inputted to a gate thereof.

The output selection circuit 40 includes multiplexers M41 and M42. The 2-input to 1-output multiplexers M41 and M42 are each configured with two analog switches, for example.

The clock signal S22 is inputted to a selection control input of the multiplexer M42, similarly to the multiplexer M22. Data inputs thereof corresponding to a low level and a high level of the clock signal S22 are connected to the intermediate potentials V2 and V1, respectively, contrary to the case of the multiplexer M22.

A clock signal S41 is inputted to a selection control input of the multiplexer M41. A data input thereof corresponding to a low level of the clock signal S41 is connected to an output of the multiplexer M42, and a data input thereof corresponding to a high level is connected to the connection point between the transistors T31 and T32. Then, the segment signal SEGj is outputted from the multiplexer M41.

—Operation of Liquid Crystal Driving Circuit—

An operation of the liquid crystal driving circuit according to an embodiment of the present invention will hereinafter be described referring to FIGS. 1 to 3 as appropriate.

The resistors R1 to R3 divide a supply voltage V0 (=VDD−VSS). The voltage follower circuit, configured with the operational amplifier OP1, impedance-converts the intermediate potential V1 generated at the connection point between the resistors R1 and R2, to be outputted. On the other hand, the voltage follower circuit, configured with the operational amplifier OP2, impedance-converts the intermediate potential V2 generated at the connection point between the resistors R2 and R3, to be outputted.

The resistors R1 to R3, whose resistance values are equal, are used. Therefore, VDD−V1=V1−V2=V2−VSS=1/3V0 is given, and the liquid crystal driving circuit performs 1/3 bias driving.

Here, referring to FIG. 3, a description will be given of an example of a specific operation of the common-signal output circuit 1 and the segment-signal output circuit 3 in the case where the liquid crystal driving circuit performs 1/4 duty driving (m=4).

Figure 3:
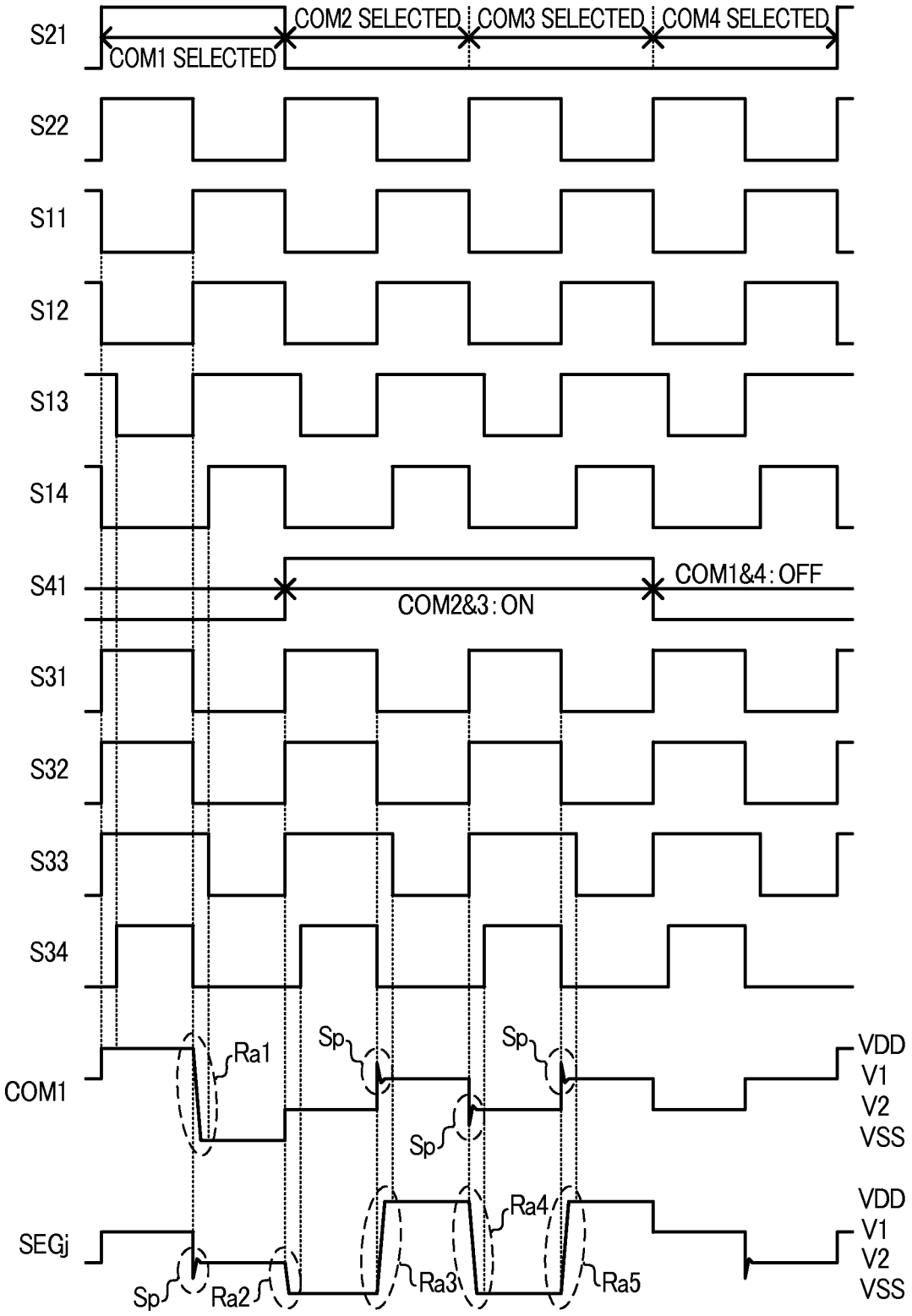
FIG. 3 is a diagram for explaining an operation of a liquid crystal driving circuit according to an embodiment of the present invention.

FIG. 3 illustrates an operation in the case where the common-signal output circuit 1 illustrated in FIG. 1 outputs the common signal COM1, and in the case of outputting the common signals COM2 to COM4, the waveforms thereof result in waveforms obtained by shifting the waveform of the common signal COM1 by 1/4 period each. Illustrated is a waveform of the segment signal SEGj in the case where two segments corresponding to the common signals COM2 and COM3 are turned on and two segments corresponding to the common signals COM1 and COM4 are turned off, among the four segments corresponding to the segment signal SEGj.

First, an operation of the common-signal output circuit 1 will be described.

The clock signal S21 is a clock signal with 1/4 duty, and a high-level period of the signal indicates a time period during which n pieces of the segments corresponding to the common signal COM1 are selected. Therefore, in the case where the common-signal output circuit 1 outputs the common signals COM2 to COM4, the waveform of the clock signal S21 is shifted by 1/4 period each. Hereinafter, the time period during which n pieces of the segments corresponding to the common signal COMi are selected and the time period during which they are not selected will be referred to as a selection period and a non-selection period of the common signal COMi, respectively.

The clock signal S22 is a clock signal with 1/2 duty whose 1 period (cycle) is equal to the selection period of each of the common signals. The clock signals S11 and S12 are both inverted signals of the clock signal S22. Moreover, the clock signal S13 is a clock signal whose falling edge alone is delayed with respect to that of the clock signal S11 by a predetermined delay time period, and the clock signal S14 is a clock signal whose rising edge alone is delayed with respect to that of the clock signal S12 by a predetermined delay time period.

If the clock signal S21 goes high (high level) and enters the selection period of the common signal COM1, the potential of the common signal COM1 outputted from the multiplexer M21 becomes equal to a potential at the connection point between the transistors T11 and T12. At the same time, the clock signals S11, S12, and S14 go low (low level) and the transistor T11 is turned on and the transistors T12 and T14 are turned off, and thus, the potential of the common signal COM1 becomes equal to the power supply potential VDD.

The clock signal S13 goes low with a delay of a predetermined delay time period with respect to the clock signal S11 and the transistor T13 is turned on, resulting in sufficiently small output impedance.

If the clock signals S11 to S13 go high concurrently in the selection period of the common signal COM1, the transistors T11 and T13 are turned off, and the transistor T12 is turned on. Therefore, a sink current corresponding to a first constant-current signal is supplied to the common electrode of the liquid crystal panel 9 from the current source IS12, as the common signal COM1. The potential of the common signal COM1 falls in a ramp form due to the sink current to become equal to the power supply potential VSS, resulting in a ramp waveform Ra1 falling from the power supply potential VDD to the power supply potential VSS.

The clock signal S14 goes high with a delay of a predetermined delay time period with respect to the clock signal S12 and the transistor T14 is turned on, resulting in sufficiently small output impedance. The delay period is set such that the clock signal S14 goes high at least after the potential of the common signal COM1 reaches the power supply potential VSS.

If the clock signal S21 goes low and enters the non-selection period of the common signal COM1, the potential of the common signal COM1 becomes equal to an output potential of the multiplexer M22. Concurrently, the clock signal S22 goes high resulting in the potential of the common signal COM1 becoming equal to the intermediate potential V2.

If the clock signal S22 goes low in the non-selection period of the common signal COM1, the potential of the common signal COM1 becomes equal to the intermediate potential V1. Thus, in the non-selection period of the common signal COM1, the potential of the common signal COM1 alternately becomes equal to the intermediate potential V2 or V1 in accordance with the level of the clock signal S22.

As described above, the common-signal output circuit 1 changes the potential of the common signal COM1 in the ramp form at least if the potential falls from the power supply potential VDD to the power supply potential VSS.

As is understood from FIG. 3, in such a driving method, the potential of the common signal COM1 does not rise from the power supply potential VSS to the power supply potential VDD. Thus, the ramp waveform generation circuit 10 includes, as a current source, only the current source IS12 connected to the power supply potential VSS.

Subsequently, an operation of the segment-signal output circuit 3 will be described.

A high-level period of the clock signal S41 indicates the selection period of the common signal COMi, corresponding to a segment to be turned on, among the four segments corresponding to the segment signal SEGj. As described above, among the four segments, the two segments corresponding to the common signals COM2 and COM3 are turned on, and the clock signal S41 is high during the selection periods of the common signals COM2 and COM3.

The clock signals S31 and S32 both are signals equivalent to the clock signal S22. The clock signal S33 is a clock signal whose falling edge alone is delayed with respect to that of the clock signal S31 by a predetermined delay time period, and the clock signal S34 is a clock signal whose rising edge alone is delayed with respect to that of the clock signal S32 by the predetermined delay time period.

During the selection periods of the common signals COM1 and COM4, the clock signal S41 is low. Therefore, the potential of the segment signal SEGj outputted from the multiplexer M41 becomes equal to the output potential of the multiplexer M42, and becomes equal to the intermediate potential V1 while the clock signal S22 is high and becomes equal to the intermediate potential V2 while the clock signal S22 is low.

When the selection period of the common signal COM2 is started, the clock signal S41 goes high, and the potential of the segment signal SEGj becomes equal to the potential of the connection point between the transistors T31 and T32. At the same time, the clock signals S31 to S33 go high, the transistors T31 and T33 are turned off, and the transistor T32 is turned on. Therefore, a sink current is supplied to the segment electrode of the liquid crystal panel 9 from the current source IS32 as the segment signal SEGj. Then, the potential of the segment signal SEGj falls in the ramp form, due to the sink current, become equal to the power supply potential VSS, resulting in a ramp waveform Ra2 falling from the intermediate potential V2 to the power supply voltage VSS.

The clock signal S34 goes high with a delay of a predetermined delay period with respect to the clock signal S32 by a predetermined delay period and the transistor T34 is turned on, resulting in sufficiently small output impedance. The delay period is set such that the clock signal S34 goes high at least after the potential of the segment signal SEGj reaches the power supply potential VSS.

In the selection period of the common signal COM2, when the clock signals S31, S32, and S34 go low at the same time, the transistor T31 is turned on and the transistors T32 and T34 are turned off. Therefore, a source current is supplied to the segment electrode of the liquid crystal panel 9 from the current source IS31 as the segment signal SEGj. Then, the potential of the segment signal SEGj rises in the ramp form due to the source current to the power supply potential VDD, resulting in a ramp waveform Ra3 rising from the power supply potential VSS to the power supply potential VDD.

The clock signal S33 goes low with a delay of a predetermined delay time period with respect to the clock signal S31 and the transistor T33 is turned on, resulting in sufficiently small output impedance. The delay period is set such that the clock signal S33 goes low at least after the potential of the segment signal SEGj reaches the power supply potential VDD.

When the selection period of the common signal COM3 is started, the clock signals S31 to S33 go high at the same time, and the transistors T31 and T33 are turned off and the transistor T32 is turned on. Therefore, a sink current is supplied to the segment electrode of the liquid crystal panel 9 from the current source IS32 as the segment signal SEGj. Then, the potential of the segment signal SEGj falls in the ramp form to the power supply potential VSS due to the sink current, resulting in a ramp waveform Ra4 falling from the power supply potential VDD to the power supply potential VSS.

The clock signal S34 goes high with a delay of a predetermined delay period with respect to the clock signal S32 and the transistor T34 is turned on, resulting in sufficiently small output impedance.

In the selection period of the common signal COM3, the operation in the case where the clock signals S31, S32, and S34 go low at the same time, is similar to that in the case of the selection period of the common signal COM2. Therefore, the potential of the segment signal SEGj results in a ramp waveform Ra5 rising from the power supply potential VSS to the power supply potential VDD similarly to the ramp waveform Ra3.

As described above, the segment-signal output circuit 3 changes the potential of the segment signal SEGj in the ramp form, at least if the potential falls from the power supply potential VDD to the power supply potential VSS or if the potential rises from the power supply potential VSS to the power supply potential VDD.

In order to realize this function, in an embodiment of the present invention, the segment-signal output circuit 3 changes the potential of the segment signal SEGj in the ramp form if the potential falls to the power supply potential VSS or rises to the power supply potential VDD. Therefore, other than the case of being changed in the ramp form with a potential difference of the power supply voltage V0, the potential of the segment signal SEGj might be changed in the ramp form with a potential difference of 1/3 V0 (=V2−VSS) as in the ramp waveform Ra2.

Further, in an embodiment of the present invention, the source current supplied from the current source IS31 and the sink current supplied from the current source IS32 as the segment signal SEGj both correspond to a second constant-current signal.

As such, the liquid crystal driving circuit in an embodiment of the present invention changes the common signal COMi and the segment signal SEGj in the ramp form at least if the potential is changed with a potential difference of the power supply voltage V0. That is, if the potential of the signal is changed with the maximum potential difference, a rising time and a falling time are provided, thereby reducing a slew rate.

Figure 9:
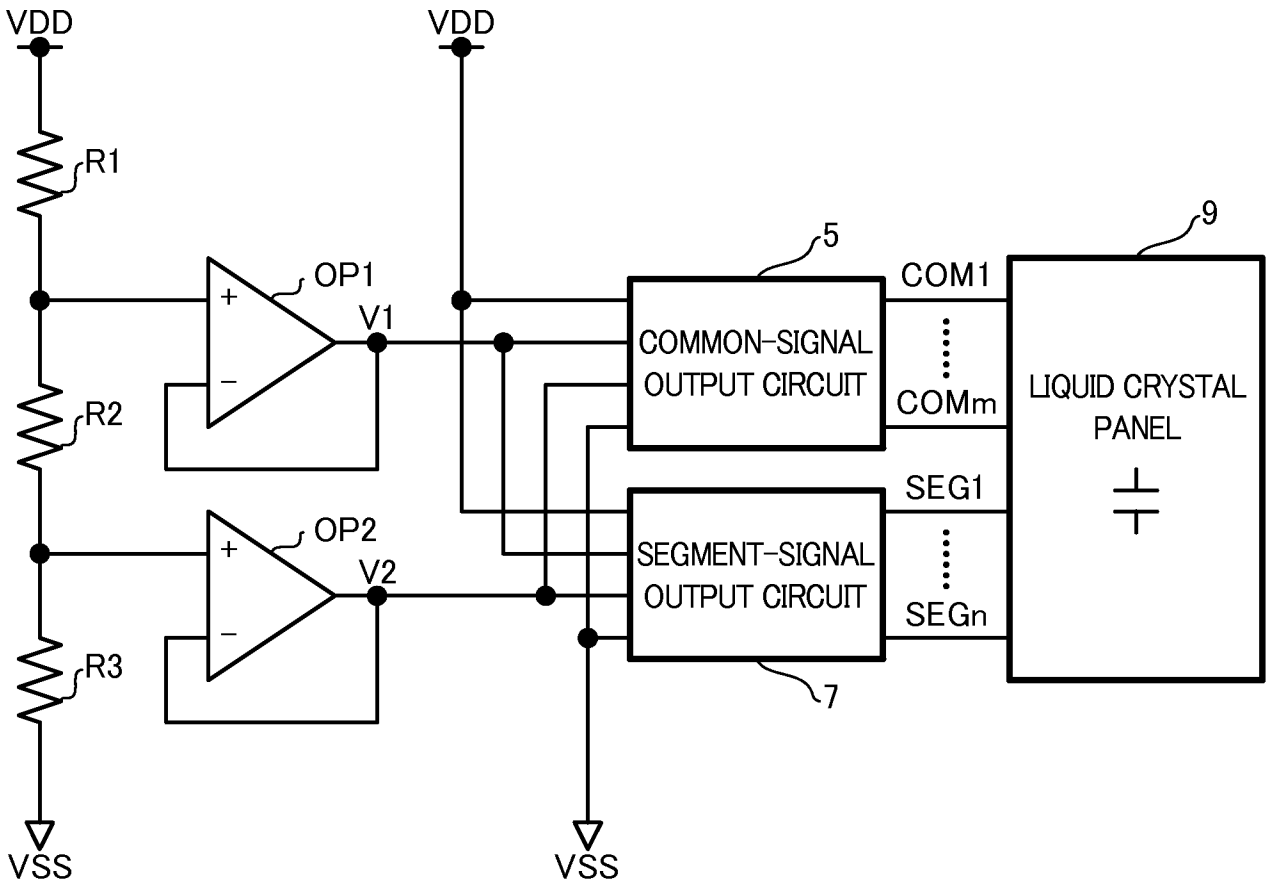
FIG. 9 is a circuit block diagram illustrating an example of a configuration of a general liquid crystal driving circuit provided with a voltage follower circuit.
Figure 10:
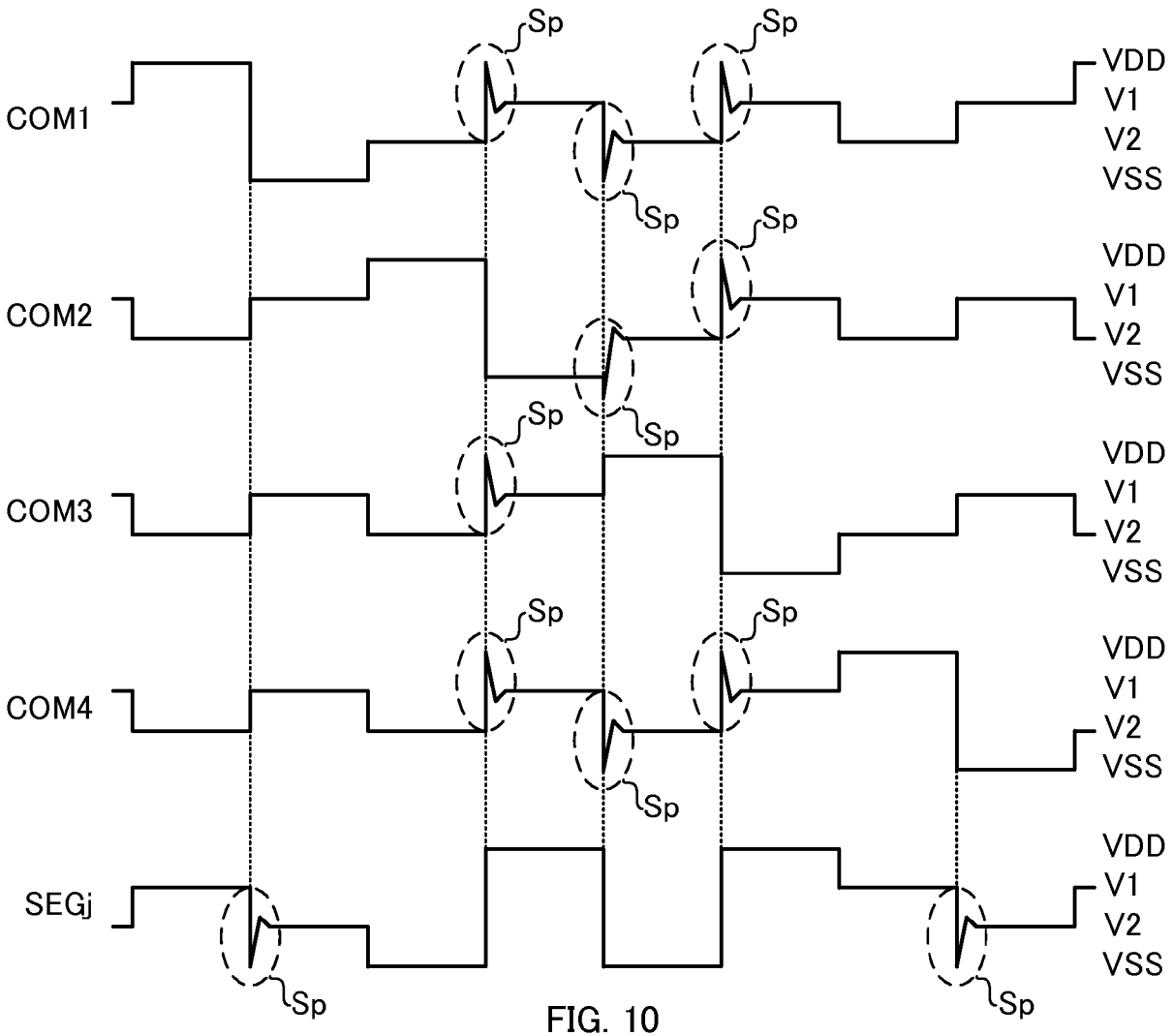
FIG. 10 is a diagram illustrating an operation of a liquid crystal driving circuit illustrated in FIG. 9.

Therefore, even if the output impedance of the operational amplifier is equivalent to that in the case of the liquid crystal driving circuit illustrated in FIGS. 9 and 10, the size and convergence time of the spike noises Sp can be reduced as illustrated in FIG. 3. Thus, while favorable display quality is ensured, current consumption and a mounting area on the circuit board can be suppressed at the same time.

The slew rate can be reduced also by attenuating a high-frequency component using an RC filter instead of setting the common signal COMi and the segment signal SEGj in the ramp waveform. However, if the RC filter is used, the slew rate immediately after rising or falling is equivalent to that in the case of the ramp waveform, but, since time for reaching the power supply potential VDD or VSS becomes long, display defects such as flickering might occur in the liquid crystal panel.

—Configuration Example of Current Supply Circuit—

In an embodiment of the present invention, ramp waveforms of the common signal COMi and the segment signal SEGj have inclinations according to the currents supplied from the current sources IS12, IS31, and IS32. Therefore, the inclinations of the ramp waveforms can be changed by making the current values of the supplied currents variable.

Figure 4:
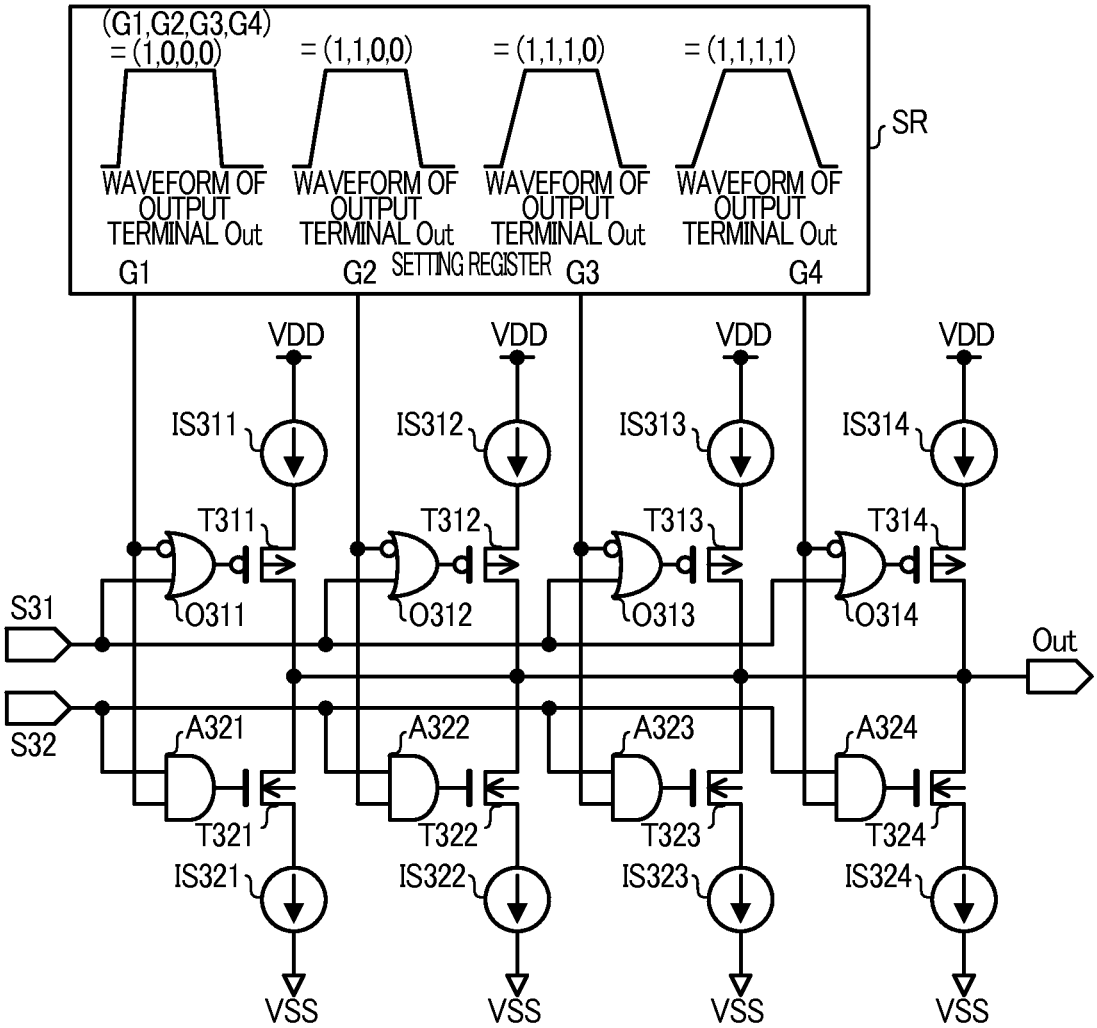
FIG. 4 is a circuit block diagram illustrating another configuration example of a current supply circuit.

FIG. 4 illustrates a configuration, as an example, in which inclination of a ramp waveform can be changed in accordance with current-value setting information (G1, G2, G3, and G4) stored in a setting register SR using four circuits corresponding to the second current supply circuits among the ramp waveform generation circuits 30.

A current source IS311 connected to the power supply potential VDD, transistors T311 and T321 and a current source IS321 connected to the power supply potential VSS are connected in series in this order, and correspond to one second current supply circuit. Also, an output signal of an OR circuit (logical sum circuit) O311, to which the clock signal S31 and an inverting signal of the current-value setting signal G1 are inputted, is inputted to a gate of the transistor T311. On the other hand, an output signal of an AND circuit (logical product circuit) A321, to which the clock signal S32 and the current-value setting signal G1 are inputted, is inputted to a gate of the transistor T321.

In the case of the current-value setting signal G1=1, the second current supply circuit can supply a current from the current source IS311 or IS321 in accordance with the clock signals S31 and S32. On the other hand, in the case of the current-value setting signal G1=0, since both of the transistors T311 and T321 are turned off regardless of the clock signals S31 and S32, a current is not supplied from the current sources IS311 and IS321. Therefore, the second current supply circuit is set to be in use or not in use in accordance with the current-value setting signal G1. Other three second current supply circuits also have similar configurations and are set to be in use or not in use in accordance with the current-value setting signals G2 to G4, respectively.

As such, by setting the current-value setting information (G1, G2, G3, and G4) as appropriate, the number of the second current supply circuits can be set, which is configured to supply currents corresponding to the second constant-current signals as the segment signals SEGj, and the inclination of the ramp waveform can be changed. Similarly, the inclination of the ramp waveform can be changed in the common signal COMi.

If the inclination of the ramp waveform is small, the spike noises Sp cannot sufficiently be suppressed, which might cause an image to remain. On the other hand, if the inclination of the ramp waveform is great, time for the potentials of the common signal COMi and the segment signal SEGj to reach the power supply voltage VDD or VSS become long, which might cause flickering or the like. Thus, by connecting the liquid crystal panel 9 in actuality and changing the inclination of the ramp waveform while the state of display is being checked, an adjustment can be made so as to obtain the optimal display quality.

—Other Driving Methods of Liquid Crystal Driving Circuit—

In an embodiment according to the present invention, the liquid crystal driving circuit has been described which is configured to use 1/3 bias driving as the driving method, but it is not limited thereto.

Figure 5:
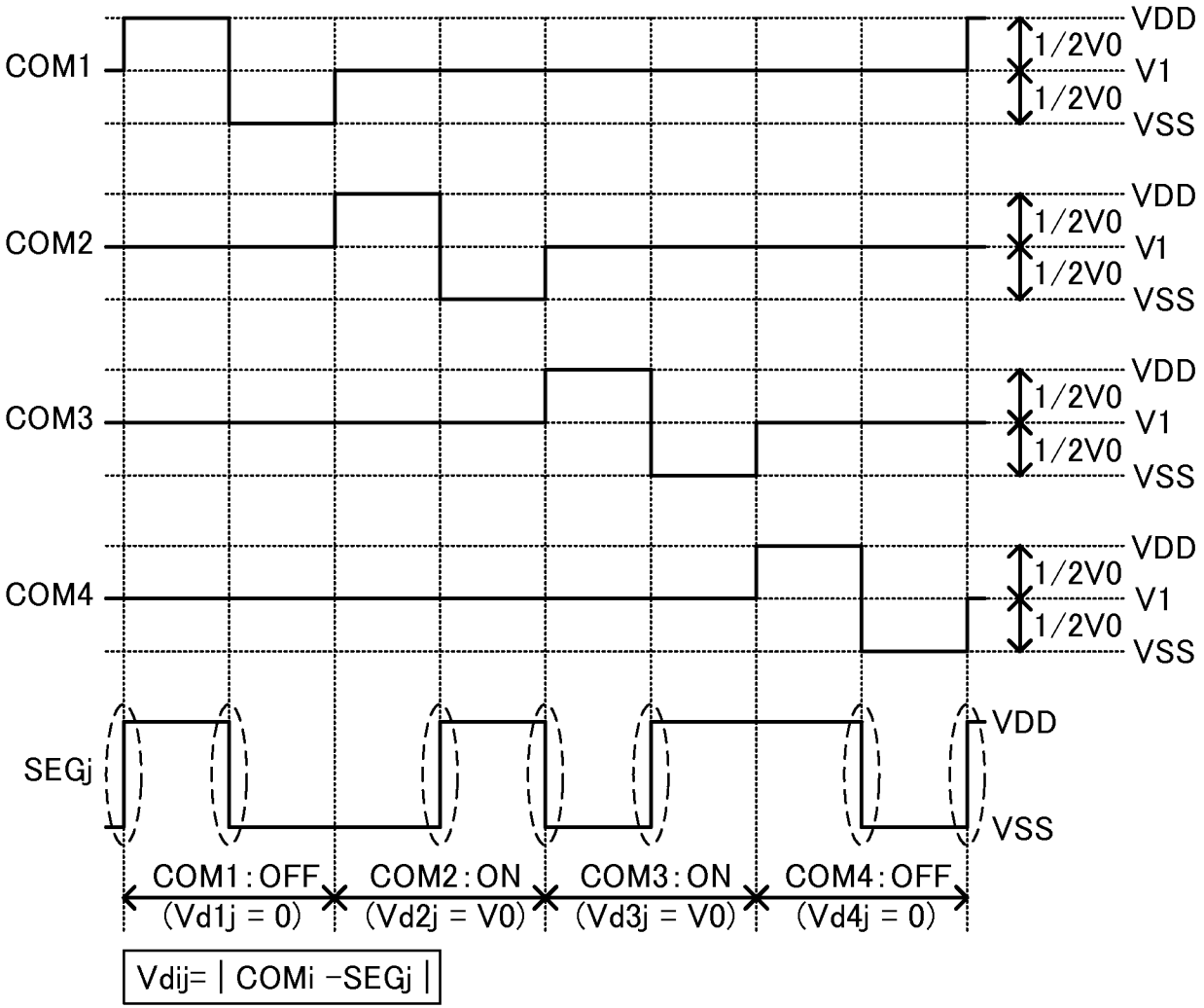
FIG. 5 is a diagram illustrating another example of a driving method of a liquid crystal driving circuit.

FIG. 5 illustrates an operation of the liquid crystal driving circuit configured to perform 1/2 bias driving. As illustrated in FIG. 5, in the 1/2 bias driving method, the segment signal SEGj is not at the intermediate potential V1 but at only the power supply potential VDD or VSS which is sufficiently stable as compared with the intermediate potential V1. Therefore, in this driving method, it is only necessary that only the segment signal SEGj is set in the ramp waveform, thereby suppressing the spike noises generated in the common signal COMi. Since all the changes in the potential of the segment signal SEGj are changes in the potential difference of the power supply voltage V0, the potential of the segment signal SEGj results in being changed in a ramp form on every occasion.

Figure 6:
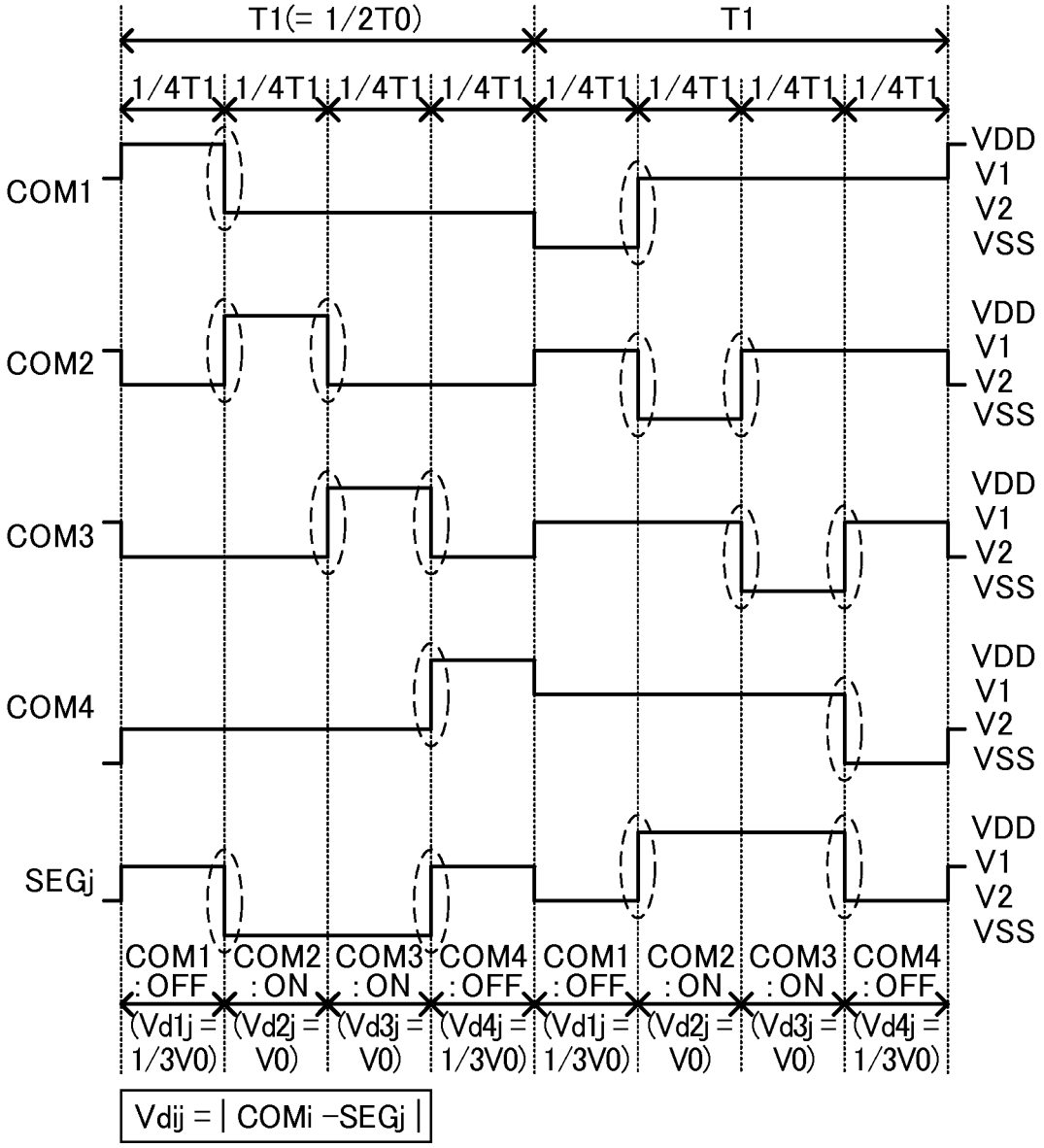
FIG. 6 is a diagram illustrating still another example of a driving method of a liquid crystal driving circuit.
Figure 7:
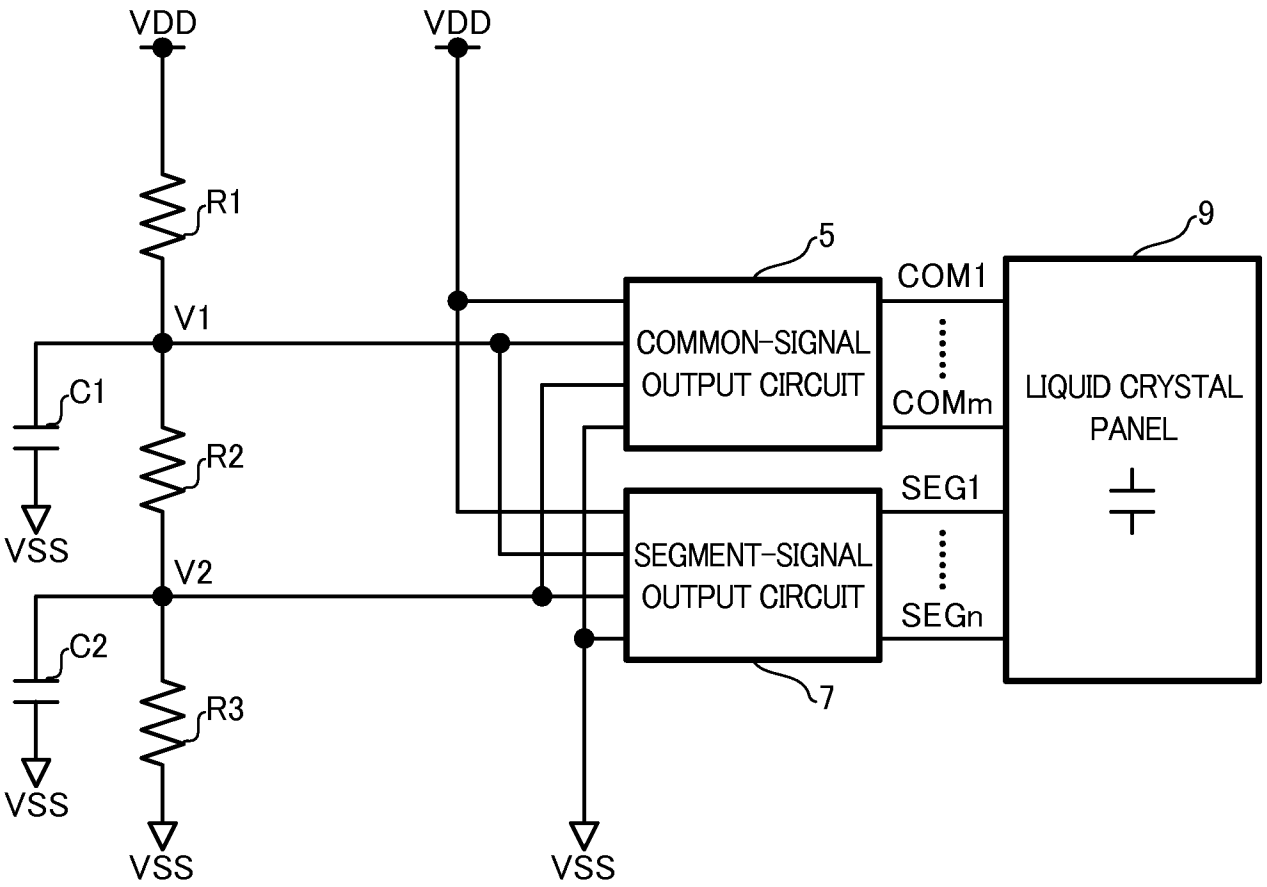
FIG. 7 is a circuit block diagram illustrating an example of a configuration of a general liquid crystal driving circuit provided with an external capacitor.
Figure 8:
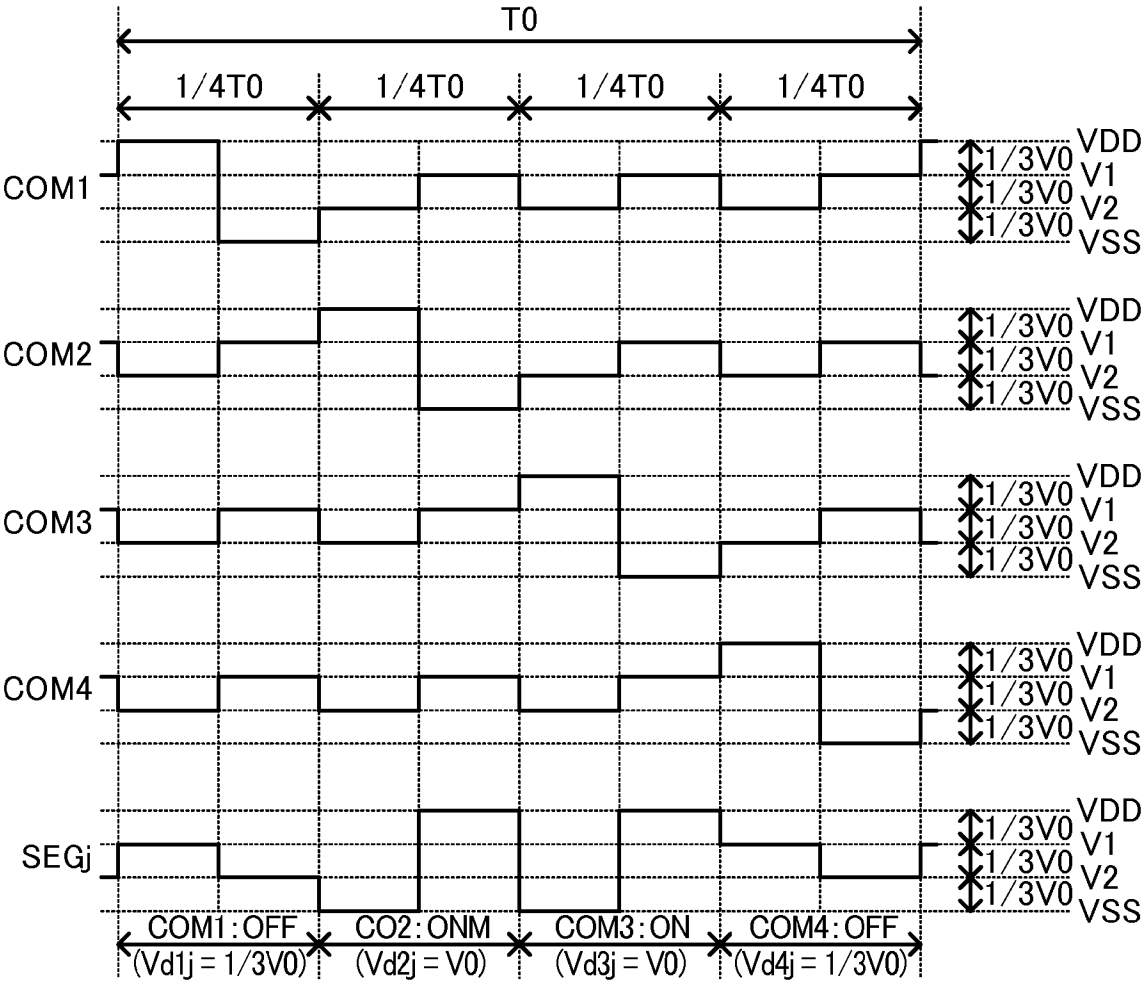
FIG. 8 is a diagram for explaining an operation of a liquid crystal driving circuit illustrated in FIG. 7.

A 1/3 bias driving method is illustrated in FIG. 6. In this driving method, the potentials of the common signal COMi and the segment signal SEGj is changed with a potential difference of 2/3 V0, which is surrounded by broken lines, but the potentials thereof are not changed with a potential difference of the power supply voltage V0. Therefore, in this driving method, the potential is changed in the ramp form at least in the case where the potentials of the common signal COMi and the segment signal SEGj are changed with the potential difference 2/3 V0 which is the maximum possible potential difference.

In any driving method, it is only necessary that the potential is changed in the ramp form at least in the case where the potentials of the common signal COMi and the segment signal SEGj are changed with the maximum potential difference, and the potential may be changed in the ramp form in the case where the potentials thereof are changed with other differences. For example, a configuration may be such that the potentials of the common signal COMi and the segment signal SEGj are changed in the ramp form on every occasion.

As described above, in the liquid crystal driving circuit including the segment-signal output circuit 3 illustrated in FIG. 1, at least in the case where the potential of the segment signal SEGj is changed with the potential difference which is the maximum possible potential difference, by changing the potential of the segment signal SEGj in the ramp form, the slew rate can be reduced and the spike noises Sp generated in the common signal COMi can be suppressed, so that favorable display quality can be ensured while current consumption and a mounting area on the circuit board can be suppressed.

Moreover, in the liquid crustal driving circuit further including the common-signal output circuit 1 illustrated in FIG. 1, at least in the case where the potential of the common signal COMi is changed with the maximum possible potential difference, by changing the potential of the common signal COMi in the ramp form, the slew rate can be reduced and the spike noises Sp generated in the segment signal SEGj can also be suppressed.

Moreover, at least in the case where the potentials of the common signal COMi and the segment signal SEGj are changed with the potential difference of the power supply voltage V0, by changing the potentials of the common signal COMi and the segment signal SEGj in the ramp form, the spike noises Sp generated in the common signal COMi and the segment signal SEGj can be suppressed, in the driving method that has a change in potential difference of the power supply voltage V0.

Moreover, by supplying the first and second constant-current signals supplied from the current sources IS12, IS31, and IS32, as the common signal COMi and the segment signal SEGj, to the common electrode and the segment electrode of the liquid crystal panel 9, respectively, the potentials of the common signal COMi and the segment signal SEGj can be changed in the ramp form.

Moreover, by setting the number of the first and second current supply circuits configured to respectively supply the first and second constant-current signals, using a plurality of the first and second current supply circuits, the inclinations of the ramp waveforms of the common signal COMi and the segment signal SEGj can be changed, and the liquid crystal panel 9 can be adjusted to be of optimal display quality.

The above embodiments of the present invention are simply for facilitating the understanding of the present invention and are not in any way to be construed as limiting the present invention. The present invention may variously be changed or altered without departing from its spirit and encompass equivalents thereof.

What is claimed is:

1. A liquid crystal driving circuit, comprising:

a plurality of resistors connected in series between a first potential and a second potential lower than the first potential;

one or more voltage follower circuits configured to impedance-convert one or more intermediate potentials between the first potential and the second potential, to be outputted, respectively, the one or more intermediate potentials generated at one or more connection points between the plurality of resistors, respectively;

a common-signal output circuit configured to supply common signals to common electrodes of a liquid crystal panel, respectively, each of the common signals being at the first potential, the second potential, and the one or more intermediate potentials in a predetermined order, wherein the common-signal output circuit is configured to change the potentials of the common signals in a ramp form, at least in a case where the potentials of the common signals are changed with a maximum possible potential difference; and a segment-signal output circuit configured to supply segment signals to segment electrodes of the liquid crystal panel, respectively, each of the segment signals being at the first potential, the second potential, and the one or more intermediate potentials in accordance with the common signals, the segment-signal output circuit configured to change the potentials of the segment signals in a ramp form, at least in a case where the potentials of the segment signals are changed with a maximum possible potential difference.

2. The liquid crystal driving circuit according to claim 1, wherein the common-signal output circuit is configured to change the potentials of the common signals in a ramp form at least in a case where the potentials of the common signals fall from the first potential to the second potential or rise from the second potential to the first potential; and wherein the segment-signal output circuit is configured to change the potentials of the segment signals in a ramp form, at least in a case where the potentials of the segment signals fall from the first potential to the second potential or rise from the second potential to the first potential.

3. The liquid crystal driving circuit according to claim 2, wherein the common-signal output circuit includes a first current supply circuit configured to supply first constant-current signals to the common electrodes as the common signals in a case where the potentials of the common signals are changed in a ramp form; and wherein the segment-signal output circuit includes a second current supply circuit configured to supply second constant-current signals to the segment electrodes as the segment signals in a case where the potentials of the segment signals are changed in a ramp form.

4. The liquid crystal driving circuit according to claim 3, wherein the common-signal output circuit includes a plurality of the first current supply circuits, and is configured to supply the first constant-current signals to the common electrodes from the first current supply circuits in a case where the potentials of the common signals are changed in a ramp form, the number of which circuits is in accordance with current-value setting information, and wherein the segment-signal output circuit includes a plurality of the second current supply circuits, and is configured to supply the second constant-current signals to the segment electrodes from the second current supply circuits in a case where the potentials of the segment signals are changed in a ramp form, the number of which circuits is in accordance with the current-value setting information.

5. The liquid crystal driving circuit according to claim 1, wherein the common-signal output circuit includes a first current supply circuit configured to supply first constant-current signals to the common electrodes as the common signals in a case where the potentials of the common signals are changed in a ramp form; and wherein the segment-signal output circuit includes a second current supply circuit configured to supply second constant-current signals to the segment electrodes as the segment signals in a case where the potentials of the segment signals are changed in a ramp form.

6. The liquid crystal driving circuit according to claim 5, wherein the common-signal output circuit includes a plurality of the first current supply circuits, and is configured to supply the first constant-current signals to the common electrodes from the first current supply circuits in a case where the potentials of the common signals are changed in a ramp form, the number of which circuits is in accordance with current-value setting information, and wherein the segment-signal output circuit includes a plurality of the second current supply circuits, and is configured to supply the second constant-current signals to the segment electrodes from the second current supply circuits in a case where the potentials of the segment signals are changed in a ramp form, the number of which circuits is in accordance with the current-value setting information.

7. A method for driving a liquid crystal panel, comprising:

generating a common signal at a first common electrode of a liquid crystal panel in response to operating in a first selection period, the common signal comprising a first waveform having first, second, third, fourth, fifth, sixth, seventh, eighth, ninth, and tenth portions, the second portion of the first waveform a ramp between the first and third portions of the first waveform, the fifth portion of the first waveform between the fourth and sixth portions of the first waveform and having spike noise, the seventh portion of the first waveform between the sixth and eighth portions of the first waveform and having spike noise, the ninth portion of the first waveform between the eighth and tenth portions of the first waveform and having spike noise, and wherein the first portion of the first waveform is at a first voltage level, the third portion of the first waveform is at a second voltage level that is less than the first voltage level, and the fourth portion of the first waveform is at a third voltage level that is intermediate between the first and second voltage levels and wherein the sixth and ninth portions of the first waveform are at a seventh voltage level and the eighth portion of the first waveform is at the third voltage level; and generating a segment signal in response to operating in the first selection period, the segment signal at a first segment electrode of the liquid crystal panel comprising a second waveform having first, second, third, fourth, fifth, sixth, seventh, eighth, ninth, and tenth portions, wherein the second portion of the second waveform includes spike noise and is between the first and third portions of the second waveform, wherein the ramp reduces the spike noise of the second portion of the second waveform, the fifth portion of the second waveform a ramp between the fourth and sixth portions of the second waveform, wherein the ramp between the fourth and sixth portion of the second waveform reduces the spike noise of the fifth portion of the first waveform, the seventh portion of the second waveform a ramp between the sixth and eighth portions wherein the ramp of the second waveform between the sixth and eighth portions reduces the spike noise of the seventh portion of the first waveform, the ninth portion of the second waveform a ramp between the eighth and tenth portions of the second waveform, wherein the ramp of the second waveform between the eighth and tenth portions reduces the spike noise of the ninth portion of the first waveform; and wherein the first portion of the second waveform is at a fourth voltage level, the third portion of the second waveform is at a fifth voltage level that is less than the first voltage level, and the fifth portion of the second waveform is at a sixth voltage level that is less than the fifth voltage level, and wherein the sixth and tenth portions of the second waveform are at an eighth voltage level and the eight portion of the second waveform is at the sixth voltage level.

8. The method of claim 7, further including adjusting an inclination of the ramp between the first and third portions of the first waveform to further reduce the spike noise.

9. The method of claim 7, wherein the ramp between the first and third portions of the first waveforms has a negative slope, the ramps between the fourth and sixth portions and the eighth and tenth portions of the second waveform have a positive slope.

10. The method of claim 7, further including adjusting an inclination of the ramp between the fourth and sixth portions of the second waveform to further reduce the spike noise.

11. The method of claim 7, further including adjusting an inclination of the ramp between the sixth and eighth portions of the second waveform to further reduce the spike noise.

12. The method of claim 7, further including adjusting an inclination of the ramp between the eighth and tenth portions of the second waveform to further reduce the spike noise.

13. A method for driving a liquid crystal panel, comprising:

providing a drive circuit having a first ramp generation stage coupled to a common signal output stage, the common signal output stage having a first output node and configured to supply common signals to common electrodes of a liquid crystal panel, each of the common signals being at the first potential, the second potential, and the one or more intermediate potentials in a predetermined order, wherein the common-signal output circuit is configured to change the potentials of the common signals in a ramp form, at least in a case where the potentials of the common signals are changed with a maximum possible potential difference; and a second ramp generation stage coupled to a segment signal output stage, the segment signal output stage having a second output node and configured to supply segment signals to segment electrodes of the liquid crystal panel, each of the segment signals being at the first potential, the second potential, and the one or more intermediate potentials in accordance with the common signals, the segment-signal output circuit configured to change the potentials of the segment signals in a ramp form, at least in a case where the potentials of the segment signals are changed with a maximum possible potential difference; and generating a common signal at the common signal output stage, the first common signal comprising a first waveform having a first ramp portion; and generating a segment signal at the segment signal output stage, the segment signal comprising a second waveform having a first portion containing spike noise, wherein the first ramp portion attenuates the spike noise of the first portion of the second waveform from a first level to a second level, the second level less than the first level.

14. The method of claim 13, wherein generating the first waveform of the common signal includes generating the first waveform having spike noise at first and second portions of the first waveform and wherein generating the second waveform of the segment signal includes generating the second waveform having first and second ramp portions, wherein the first and second ramp portions of the second waveform attenuate the spike noise at the first and second portions of the first waveform from a third level to a fourth level, the fourth level less than the third level.

15. The method of claim 14, wherein generating the first waveform having spike noise at first and second portions of the first waveform includes generating spikes in a positive direction in the first portion of the first waveform and a negative direction in the second portion of the first waveform and wherein generating the second waveform having first and second ramp portions includes generating a ramp having a positive slope in the first portion of the second waveform and a negative slope in the second portion of the second waveform.

16. The method of claim 13, wherein generating the first waveform having the first ramp portion includes generating the first ramp portion having a negative slope and wherein generating the second waveform having the first portion containing spike noise includes generating a spike in a negative direction.

17. A liquid crystal driving circuit, comprising:

a common-signal output circuit, comprising:

a first ramp waveform generation circuit having a plurality of inputs and an output; and a first output selection circuit having a plurality of inputs and an output and configured to supply common signals to common electrodes of a liquid crystal panel, each of the common signals being at the first potential, the second potential, and the one or more intermediate potentials in a predetermined order, wherein the common-signal output circuit is configured to change the potentials of the common signals in a ramp form, at least in a case where the potentials of the common signals are changed with a maximum possible potential difference and wherein a first input of the plurality of inputs of the first output selection circuit is coupled to the output of the first ramp waveform generation circuit; and a segment-signal output circuit, comprising:

a second ramp waveform generation circuit having a plurality of inputs and an output; and a second output selection circuit having a plurality of inputs and an output configured to supply segment signals to segment electrodes of the liquid crystal panel, each of the segment signals being at the first potential, the second potential, and the one or more intermediate potentials in accordance with the common signals, the segment-signal output circuit configured to change the potentials of the segment signals in a ramp form, at least in a case where the potentials of the segment signals are changed with a maximum possible potential difference and wherein a first input of the plurality of inputs of the second output selection circuit is coupled to the output of the second ramp waveform generation circuit.

18. The liquid crystal driving circuit of claim 17, wherein the first ramp waveform generation circuit comprises:

a first current source having first and second terminals;

a first switch having a control terminal and first and second current carrying terminals, the second current carrying terminal coupled to the first terminal of the first current source;

a second switch having a control terminal and first and second current carrying terminals, the second current carrying terminal of the second switch coupled to the first current carrying terminal of the first switch;

a third switch having a control terminal and first and second current carrying terminals, the second current carrying terminal of the third switch coupled to the second terminal of the first current source and the first current carrying terminal of the third switch coupled to the first and second current carrying terminals of the first and second switches, respectively, which serve as the output of the ramp waveform generation circuit; and a fourth switch having a control terminal and first and second current carrying terminals, the second current carrying terminal of the fourth switch coupled to the first current carrying terminal of the third switch.

19. The liquid crystal driving circuit of claim 18, wherein the first output selection circuit comprises:

a first multiplexer having first and second inputs, a control input, and an output; and a second multiplexer having first and second inputs, a control input, and an output, the first input of the second multiplexer coupled to the output of the first multiplexer, the second input of the second multiplexer coupled to the output of the ramp waveform generation circuit, and the output of the second multiplexer serving as the output of the common-signal output circuit.

20. The liquid crystal driving circuit of claim 18, wherein the second ramp waveform generation circuit comprises:

a first current source having first and second terminals;

a first switch having a control terminal and first and second current carrying terminals, the second current carrying terminal coupled to the first terminal of the first current source;

a second switch having a control terminal and first and second current carrying terminals, the second current carrying terminal of the second switch coupled to the first current carrying terminal of the first switch;

a third switch having a control terminal and first and second current carrying terminals, the second current carrying terminal of the third switch coupled to the second terminal of the first current source and the first current carrying terminal of the third switch coupled to the first and second current carrying terminals of the first and second switches, respectively, which serve as the output of the ramp waveform generation circuit;

a fourth switch having a control terminal and first and second current carrying terminals, the second current carrying terminal of the fourth switch coupled to the first current carrying terminal of the third switch; and a second current source having first and second terminals, the first terminal coupled to the first current carrying terminal of the fourth switch and the second terminal coupled to the first current carrying terminal of the first switch.

* * * * *